US005247893A

United States Patent [19]

Zafiroglu

[11] Patent Number: 5,247,893

[45] Date of Patent: Sep. 28, 1993

[54] STRETCHABLE STITCHBONDED FABRIC

[75] Inventor: Dimitri P. Zafiroglu, Wilmington, Del.

[73] Assignee: E. I. Du Pont de Nemours and Company, Wilmington, Del.

[21] Appl. No.: 997,372

[22] Filed: Dec. 30, 1992

Related U.S. Application Data

[62] Division of Ser. No. 768,129, Sep. 26, 1991, Pat. No. 5,187,952.

[51] Int. Cl.[5] ..... D05B 1/00; D04B 23/08; A47C 31/00

[52] U.S. Cl. ..... 112/262.1; 66/192; 2/69; 5/500

[58] Field of Search ..... 66/192, 193; 112/262.1; 2/69, 400; 5/499, 500

[56] References Cited

U.S. PATENT DOCUMENTS

| | | | |
|---|---|---|---|
| 3,611,754 | 10/1971 | Ehrlich et al. | 66/84 |
| 4,639,949 | 2/1987 | Ales et al. | 2/400 |
| 4,702,957 | 10/1987 | Mudge | 5/499 X |
| 4,704,321 | 11/1987 | Zafiroglu | 428/230 |
| 4,716,596 | 1/1988 | Hofman | 2/69 |
| 4,773,238 | 9/1988 | Zafiroglu | 66/192 |
| 4,876,128 | 10/1989 | Zafiroglu | 428/102 |
| 4,893,482 | 1/1990 | Frenzel et al. | 66/190 |
| 4,932,344 | 6/1990 | Tatum | 5/497 X |
| 4,962,546 | 10/1990 | Vitale | 5/497 |
| 4,998,421 | 3/1991 | Zafiroglu | 66/192 |
| 5,038,584 | 8/1991 | Wildeman | 66/85 A |
| 5,056,441 | 10/1991 | Seago | 112/262.1 X |
| 5,127,115 | 7/1992 | Williams et al. | 112/262.1 X |
| 5,174,228 | 12/1992 | Grimnes | 112/262.1 |
| 5,177,821 | 1/1993 | Kawtoski | 5/497 |
| 5,187,952 | 2/1993 | Zafiroglu | 66/192 |

*Primary Examiner*—Clifford D. Crowder
*Assistant Examiner*—John J. Calvert

[57] ABSTRACT

A stretchable stitchbonded fabric, suitable for forming into conformable apparel, fitted furniture covers or the like, is stitched with elastic yarns to form at least two longitudinal regions of differing stretchability, each region having minimum stretchability of 30% and one region being least 1.5 times as stretchable as the other region.

5 Claims, 4 Drawing Sheets

STRETCHABLE STITCHBONDED FABRIC

This is a division of application Ser. No. 07/768,129, filed Sep. 26, 1991, U.S. Pat. No. 5,187,952.

BACKGROUND OF THE INVENTION

1. Field of the Invention

This invention relates to a stretchable stitchbonded fabric having a nonwoven layer of substantially nonbonded fibers of textile decitex, into which elastic thread has been multi-needle stitched to form spaced apart, parallel, longitudinal rows of stitches. More particularly, the invention concerns such a fabric in which parallel longitudinal regions differ significantly in stretchability.

2. Description of the Prior Art

Stretchable stitchbonded fabrics are known, as for example, from my earlier U.S. Pat. Nos. 4,773,238, 4,876,128 and 4,998,421. Such fabrics are made by multi-needle stitching a nonwoven layer of substantially nonbonded textile fibers with elastic threads. The threads form spaced apart, parallel rows of stitches and provide a final fabric with stretchability in the stitching direction (referred to herein as the "longitudinal direction" or "LD") and in the direction transverse thereto (referred to herein as the "transverse direction" or "TD"). All regions of the fabric have substantially the same stretch characteristics in a given direction. Although such fabrics have been useful in many applications, the utility of stitchbonded stretch fabrics could be significantly enhanced, if different regions of the fabric were of different stretchability.

The manufacture of upholstery, seat covers, clothing, shoe covers, industrial garments and the like, often requires cutting and sewing of many separate pieces to provide for the various wider and narrower portions of the article being made. ,In the manufacture of articles, such as fitted mattress pads, furniture slip covers, and the like, improvements are desired in the elastic portion that holds the article in place. An object of this invention is to provide an improved stretchable stitchbonded fabric that has regions of differing stretchability which permit simplification of such manufacturing operations.

SUMMARY OF THE INVENTION

The present invention provides an improved stretchable stitchbonded fabric which comprises a layer of substantially nonbonded fibers of textile decitex that has spaced apart, parallel rows of stitches of elastic thread extending along the length of the fabric. In accordance with the improvement of the present invention, the fabric has at least two stitchbonded regions o differing stretchability that extend along the length of the fabric. Each region has a stretchability in at least one direction of at least 30 percent, preferably at least 70%, most preferably at least 150%. The ratio of stretchability in a given direction of the most stretchable region to that of the least stretchable region of the fabric is at least 1.5, and preferably at least 3. The invention also provides an improved process for converting the stretchable stitchbonded fabric into articles such as a stretchable skirt for a fitted mattress pad, a panty for use over diapers and an industrial protective garment.

BRIEF DESCRIPTION OF THE DRAWINGS

The invention will be better understood by referring to the attached drawings.

Figure 2:
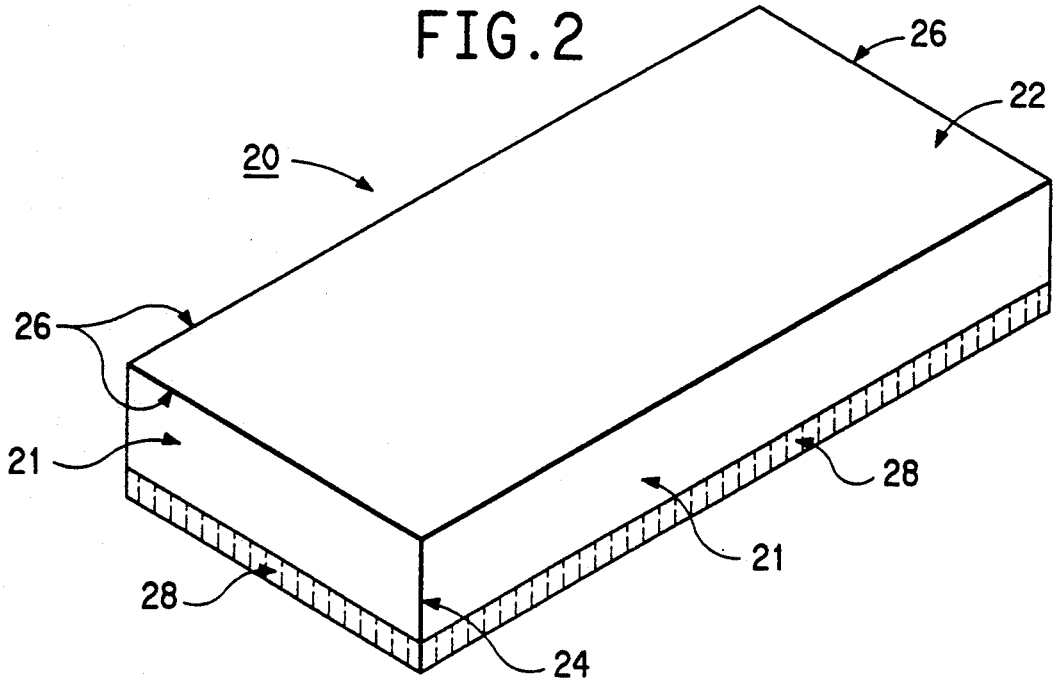
FIG. 2 illustrates a fitted mattress pad 20 having an elastic skirt 21 made from stitchbonded fabric of FIG. 1. The skirt is seamed at 26 to an upper quilted pad 22; is attached at its bottom end to a heavy elastic band 28; and seamed at 24 to close skirt 21.
Figure 4:
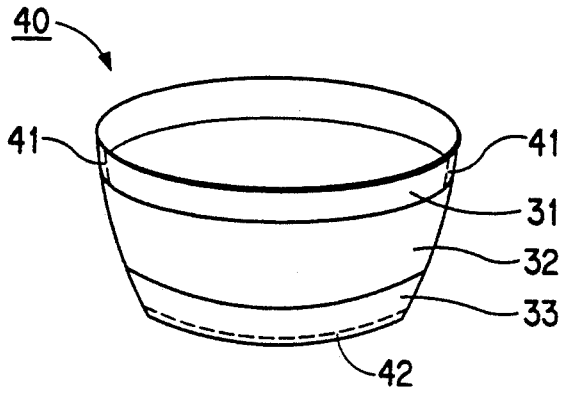
FIG. 4 is a sketch of an elastic panty 40 made from two congruent layers of stitchbonded fabric 30 of FIG. 3. The layers are joined together by seams 41 and 42. The position of lanes 31, 32 and 33, as they appear in the completed panty, is also shown in the figure.
Figure 5:
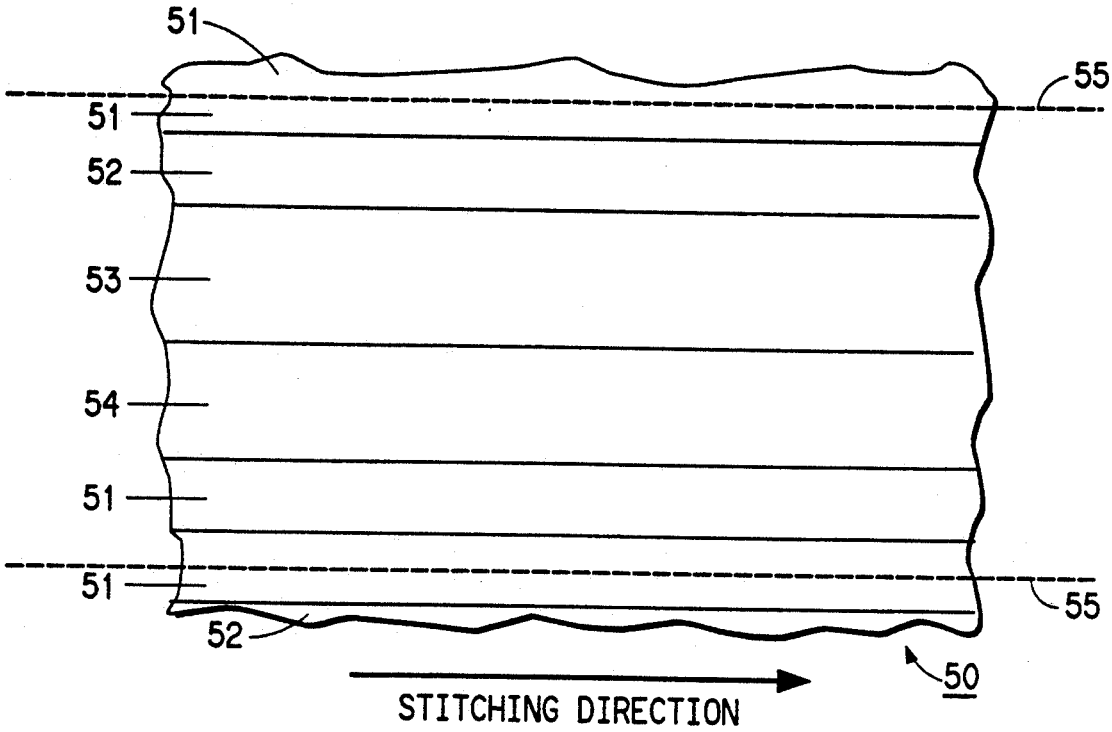
FIG. 5 is a plan view of a stitchbonded fabric 50 of the invention having a repeating pattern of stitchbonded lanes 51, 52, 53 and 54 across the width of fabric. The four regions differ in stretchability. Dashed lines 55 represent lines along which longitudinal cuts will be made to provide widths suitable for the manufacture of a protective garment.
Figure 6:
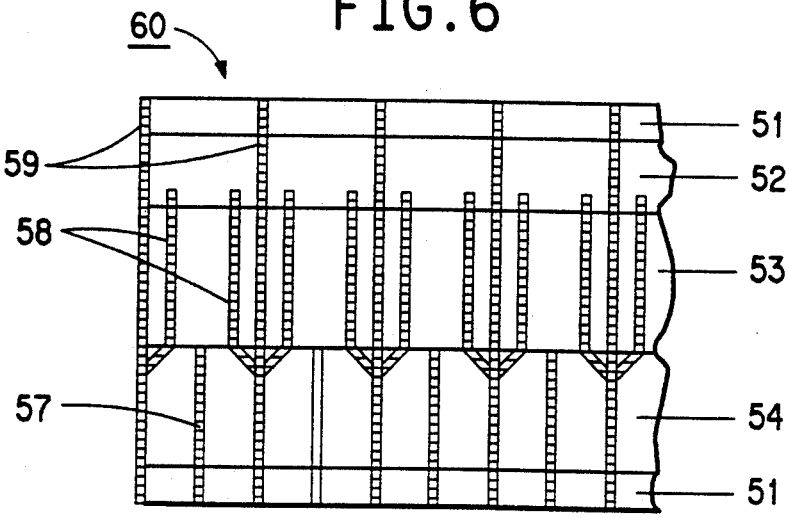
FIG. 6 shows double seams 57, 58 and 59 which are made in two congruent layers of stitchbonded fabric 50 of FIG. 5 so that protective garments 60 can be fashioned therefrom. The position of stitchbonded lanes 51, 52, 53 and 54 in the garments is also indicated.
Figure 8:
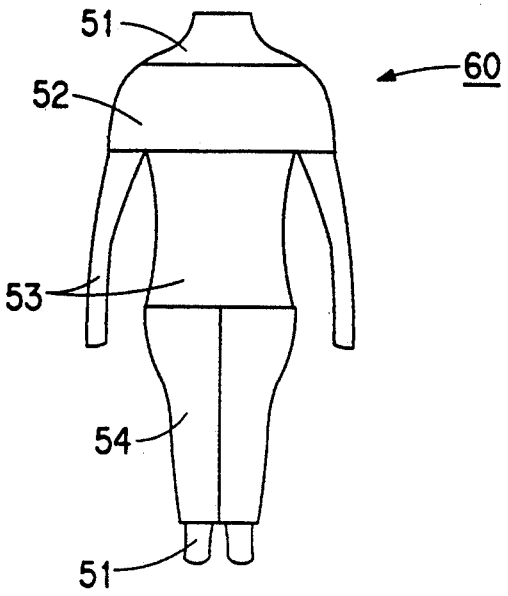
FIG. 8 illustrates a completed, heat-treated protective garment 60 made from stitchbonded fabric 50 of FIG. 5. The position of lanes 51, 52, 53 and 54, as they appear in the final garment, is also shown in the figure.

Further details of the drawings are given in the examples, wherein Example 1 describes the manufacture of the skirt and fitted mattress pad of FIG. 2; Example 2, the panty of FIG. 4; and Example 3, the protective suit of FIG. 8.

DETAILED DESCRIPTION OF PREFERRED EMBODIMENTS

In accordance with the present invention, a stitchbonded stretchable fabric is provided with stitchbonded lanes of differing stretchability. The lanes are created during stitchbonding of a substantially nonbonded layer of fibers of textile decitex by stitchbonding different regions (i.e., "lanes") of the fabric in different ways. Certain lanes of the fabric have a stretchability in a given direction that is at least 1.5 times as great as the stretchability in the same direction of the least stretchable lanes. Preferably, the ratio of the stretchability of the most stretchable lane to the least stretchable lane is preferably at least 3, though sometimes the ratio can be as as high as 10. All lanes of the fabric of the invention have a stretchability in at least one direction of at least 30%, preferably at least 70%, and most preferably at least 150%. Fabrics of the invention also preferably have a stretchability perpendicular to the most stretchable direction that is at least 30%.

The differences in stretchability among various longitudinal lanes of the fabric can be achieved in several ways. Different stitching threads or yarns, having differing amounts of elastic or retractive power can be utilized in the different stitchbonded lanes. Different stitches, repeating stitch patterns, stitch densities, and the like, also can provide differences in stretchability among lanes. The elastic stitching yarn can be shrinkable or bulkable. When the stitched yarns have high residual stretch (defined hereinafter), the stretchability can be activated immediately upon release of the fabric from tension in the stitchbonding machine. When shrinkable elastic yarns or yarns with high retractive force are employed for the stitching, the yarns can cause the fabric to contract. The amount that the fabric contracts and the amount that the elastic yarns can extend beyond their original stitched dimensions contribute to the total stretchability of the stitchbonded lanes. Thus, depending on the particular stitching, the elastic nature of the stitching yarn, the residual stretch in the as-stitched yarn, the response of the stitching yarns to post-stitching treatments (e.g., heat treatment, exposure to steam, etc.) and the particular treatment of the finished fabric, the stretchability of various lanes of the fabric can be varied and controlled so that some lanes become more stretchable than others.

The term "substantially nonbonded", as used herein with regard to the starting layer of fibers, means that the fibers generally are not bonded to each other, by thermal, chemical or other means. However, the term is intended to include a small amount of point bonding, line bonding or the like, as long as the bonding is not sufficient to prevent the stitchbonded lane from stretching or contracting after stitching.

As used herein, the term "fiber" includes staple fibers and/or continuous filaments. The term "textile decitex" means fibers having a dtex in the range of 1 to 22. The fibers may be naturally occurring fibers or fibers made of synthetic organic polymers.

Various starting layers of textile-dtex fibers are suitable for use in the present invention. Among suitable starting layers are batts of carded fibers, air-laid fiber batts, nonwoven sheets of continuous filaments, lightly consolidated or lightly bonded spunbonded sheets, sheets of hydraulically entangled fibers, and the like.

To prepare stitchbonded fabrics in accordance with the present invention, conventional multi-needle stitching equipment, having one or more needle bars, can be employed. In the stitching step, spaced apart, parallel rows of stitches are formed in the fibrous layer, the rows extending along the length of the fabric. Substantially any strong elastic thread or yarn is suitable for the stitching. Conventional yarns, such as bare or covered yarns of spandex or rubber, and textured stretch yarns of nylon or polyester or other synthetic polymers, are well suited for use in the fabrics of the invention. Yarns that can be made to shrink after stitching, as for example, by treatment with steam, heat or chemicals are also useful.

A particularly preferred stitching thread is a spandex elastomeric yarn that has high elongation (e.g., 300–800%) and high retractive power. Such preferred yarns are available commercially (e.g., "Lycra" spandex yarn sold by E. I. du Pont de Nemours and Company).

The number of rows of stitches that are inserted into the fibrous layer by the multi-needle stitchbonding machine, generally is in the range of 1 to 10 per centimeter across the width of the fabric (i.e., transverse to the stitching direction). Machines with 6-gauge, 12-gauge or 25-gauge needle bars are suitable. The number of stitches along the length of each row is usually also in the range of 1 to 10 stitches per cm.

Specific yarns, stitch patterns, stitch frequency, number of needle bars, etc. are selected to provide stitchbonded fabrics that have lanes of predetermined widths in which the amount of stretch, elastic power, direction of elastic stretch and gather, differ from lane to lane. This permits each lane to serve a different function, if desired, in the preparation of a finished article. For example, a fabric for fashioning into long-leg underwear can be prepared with (a) a lane that is of high stretchability and suited for the waist section, (b) a wide lane of lesser stretchability intended for the the lower torso and leg portions, which lane is connected at one edge to the highly stretchable lane and (c) another lane of high stretchability suited for the ankle portion of the underwear, which lane is connected to other edge of the lane of lower stretchability.

After stitchbonding, the fabrics are usually wound up in a flat condition, under about the same tension as when the fabric exited from the stitchbonding machine. In manufacturing articles from stitchbonded fabrics, it is preferred to handle the fabric in a flat planar condition to permit ease of slitting, cutting, sealing, sewing, thermal joining and other operations. Accordingly, it is sometimes desirable to allow the stretchability characteristics of each lane to be developed, after an article has been made from the fabric.

The parameters of lane stretchability and stitching yarn residual stretch, mentioned herein, are measured by the following procedures.

The method for measuring stretchability of the various lanes of the stitchbonded fabric applies to as-stitched fabrics and to fabrics that were subjected to a post-stitching treatment (e.g., a C-wash and dry cycle). Longitudinal strips measuring 1-inch (2.5-cm) wide and 8-inches (20-cm) long are cut within each different lane of the fabric. Transverse strips of the same dimensions also are cut. In some cases, the transverse samples span more than one lane. A standard length of 2.5 cm, parallel to the long edge of the strip, is marked near the middle of the sample. The strip is clamped at opposite ends of a 5-cm length of the strip, with the initially marked 2.5-cm length centrally located between the clamps. The strip is then subjected to tension by suspending a 10-pound (4.54 kg) weight from the lower clamp. This load was usually sufficient to elongate the samples described in the Examples below to near their break elongation. The extended length, $L_f$, of the original 2.5-cm mark is then re-measured. Stretchability in a given direction, as a percentage of original length, is then calculated by the formula:

$$\%\ Stretchability = 100(L_f - 2.5)/2.5$$

The percent residual stretch, %RS, remaining in elastic stitching yarn fed to the needles of the stitchbonder is determined as follows. After steady conditions for manufacturing the stitchbonded fabric have been established in the stitchbonding machine, the machine is stopped. A 25-cm length of stitching yarn is cut from the yarn just upstream of the point at which it enters the guide of a stitching needle. The cut length is allowed to relax for 30 seconds and assume a relaxed, retracted length, $L_r$, which is then measured. Percent elongation at break of the elastic yarn, $E_b$, is determined (e.g., by conventional techniques, such as ASTM D 2731-72 for elastic yarns, or as reported by the manufacturer). Then, the percent initial stretch in the elastic feed yarn just upstream of the needle-bar guide, "$S_i$", is calculated by $$Si = 100\ [(25/L_r) - 1].$$

Then, percent residual stretch is calculated by $$\%RS = 100\ [(E_b/S_i) - 1].$$

The invention is further illustrated by the following examples of preferred embodiments. These examples are included for purposes of illustration only and are not intended to limit the scope of the invention, which is defined by the appended claims.

EXAMPLES

Each of the following three examples illustrate the manufacture of a different stitchbonded fabric of the invention and its use in a particular article for which the fabric was specifically intended. A 3.5-meter-wide Liba two-bar multi-needle stitching machine was used in each example to prepare the fabric. The machine was operated with (a) residual stretch in the elastic stitching yarns fed to the needle bars, (b) zero overfeed of the fibrous starting layers, and (c) light tension on the stitchbonded product that was wound up immediately after stitching.

EXAMPLE I

This example describes the production of a fitted mattress pad having an elastic skirt formed from a stitchbonded fabric of the invention. The fabric has two types of lanes which, in the as-stitchbonded (i.e., as formed) fabric differ in longitudinal stretchability by a factor of 3.2 and after exposure to a wash-and-dry cycle, by a factor of 4.1.

Figure 1:
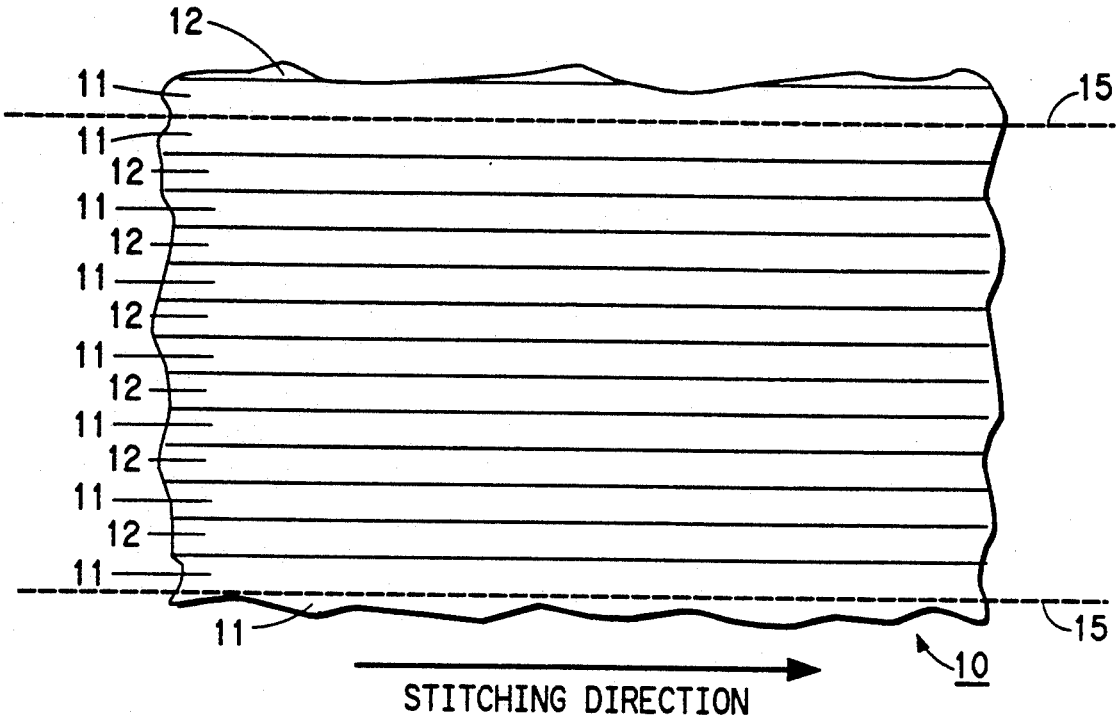
FIG. 1 is a plan view of a stitchbonded fabric 10 of the invention having stitchbonded lanes 11 and 12 of differing stretchability. Fabric 10 has a thirteen-lane repeating pattern across its width, composed of twelve alternating one-inch-wide stitchbonded lanes 11 and 12 followed by another one-inch-wide lane 11. Dashed lines represent lines along which longitudinal cuts will be made to provide widths suitable for an elastic skirt of a fitted mattress pad.

The starting fibrous layer for the stitchbonded fabric was a 1.2-oz/yd$^2$ (40.7-g/m$^2$) Sontara ® 8000 spunlaced sheet of hydraulically entangled polyester fibers (T-106 Dacron ® sold by E. I. du Pont de Nemours and Company) of 1.5 dtex and about 2.2-cm length. Details of the stitching operation are summarized in Table I, below, along with characteristics of the fabric produced. FIG. 1 depicts the resultant stitchbonded fabric. FIG. 2, illustrates a fitted mattress pad made with an elastic skirt of this example.

As indicated in Table 1, a nylon-covered, 70-den (78 dtex), T-126 Lycra ® spandex yarn (Type LO523 sold by Macfield Texturing Inc. of Madison, N.C.), designated Y-1 in Table 1, and having a break elongation of about 380%, was employed on the front bar of the stitching machine to form 0-1,1-0 chain stitches in lanes 12 of the fabric. Conventional warp knitting nomenclature is used to identify the stitch patterns. Lycra ® is a spandex made by E. I. du Pont de Nemours and Company. On the back bar of the stitching machine, a 77 dtex textured nylon stretch yarn (also sold by Macfield Texturing Inc.), designated Y-2, was employed to form 1-0,2-3 stitches in all lanes of the fabric. The thusly produced fabric had substantial LD and TD stretchability, both as-formed and after the wash/dry cycle. Note that the lanes differed in LD stretchability by a factor of greater than 3 and stretchability in both TD and LD was greater than 60%.

The stitchbonded fabric was then used as an elastic skirt for a fitted mattress pad in the following manner. (Refer to FIGS. 1 and 2.) Stitchbonded fabric 10 was wound up on a roll under light tension. The fabric was then longitudinally slit along lines 55 to form 13-inch-wide strips 21 having the previously described repeating lane pattern. A strip 21 was held at its longitudinal edges and under light longitudinal tension and fed to a conventional sewing machine. One long edge of stitchbonded strip 21 was sewn at seam 26 to the periphery of a 6-foot-long by 4-foot-wide quilted mattress pad 22. The other long edge of strip 21 was attached by sewing to an extended, heavy, elastic band 28. A final seam 24 was then sewn to complete elastic skirt 21. Because the stitchbonded strip possessed stretchability across its width as well as its length, the skirt could readily be used for mattresses of different thickness. The longitudinal stretchability of the skirt, with its attendant retractive forces, provided a snug fit around the periphery of a mattress. The heavy elastic band at the bottom edge of the skirt assured that the part of the skirt that is normally located under the mattress would be held firmly in place.

TABLE 1

| Example I (See FIG. 1) | | |
|---|---|---|
| Stitchbonding Lane | 12 | 11 |
| Front Bar | | |
| LD stitches/inch | 9 | — |
| TD stitches/inch | 12 | — |
| Width, inch | 1 | — |
| Stitching thread | Y-1 | none |
| % RS (residual stretch) | 20 | — |
| Pattern | 0-1, 1-0 | — |
| Back Bar | | |
| LD stitches/inch | 9 | 9 |
| TD stitches/inch | 12 | 12 |
| Width, inch | 1 | 1 |
| Stitching thread | Y-2 | Y-2 |
| % RS | 15 | 15 |
| Pattern | 1-0, 2-3 | 1-0, 2-3 |
| Fabric stretchability | | |
| As formed | | |
| Weight, g/m$^2$ | 64 | 51 |
| Longitudinal, % | 190 | 60 |
| Transverse, % | 80 | 80 |
| After wash/dry cycle | | |
| Longitudinal, % | 330 | 80 |
| Transverse, % | 90 | 90 |
| Maximum-to-Minimum Lane Stretchability | | |
| As-formed Longitudinal | 3.2 | |
| Transverse | 1.0 | |
| After wash/dry Longitudinal | 4.1 | |
| Transverse | 1.0 | |

EXAMPLE II

This example describes the production of a diaper panty from two layers of stitchbonded fabric of the invention. The fabric, which has three lanes of differing stretchability, was highly stretchable in both the LD and TD. The least stretchable lane had an LD stretchability of 80% and the most stretchable lane was at least 2.5 times as stretchable. In the transverse direction the least stretchable lane had a stretchability of 120%.

The starting fibrous layer for the fabric was a substantially nonbonded 0.55 oz/yd$^2$ (19 g/m$^2$) ReemayR 501 spunbonded polyester sheet made of 1.8-den (2.0-dtex)

continuous filaments (sold by Reemay, Inc. of Old Hickory, Tenn.). Table 2 below summarizes the manner in which the layer was stitchbonded with stitching yarns Y-3 and Y-4. Stitching yarn Y-3, a 154-dtex, bare Lycra® spandex yarn (sold by E. I. du Pont de Nemours and Company), was used on the front bar of the stitchbonding machine to form 1-2,1-0 tricot stitches in each lane of the stitchbonded fabric. Stitching yarn Y-4, which was used on the back bar to form 1-0,2-1 tricot stitches in lanes 33 only, was a nylon-covered, 78-dtex, T-126 Lycra® spandex yarn (Type L0523 sold by Macfield Texturing Inc.).

Figure 3:
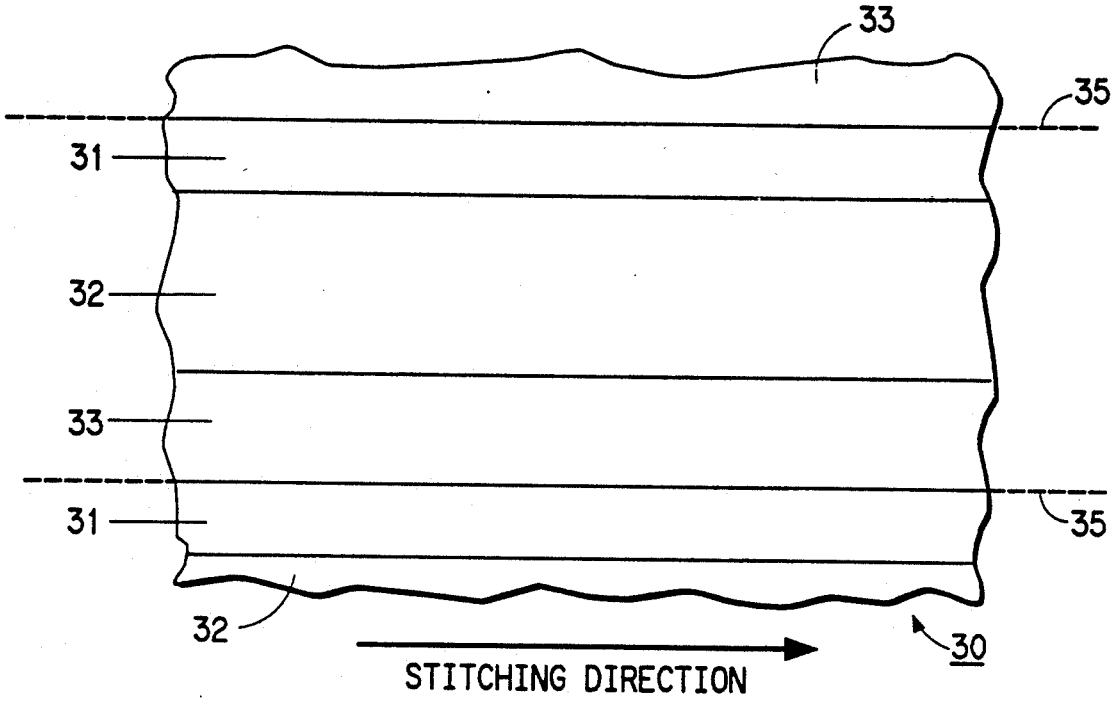
FIG. 3 is a plan view of a stitchbonded fabric 30 of the invention having a repeating pattern of stitchbonded lanes 31, 32 and 33 across the width of fabric 30. The three lanes differ in stretchability. Dashed lines 35 represent lines along which longitudinal cuts will be made to provide widths suited for simplified manufacture of an elastic panty.

Table 2 shows that the resultant product had very high stretchability in both the longitudinal and transverse directions of each lane of the resultant fabric and high ratios of stretchabilities (both LD and TD) of the most stretchable to the least stretchable lanes of the fabric. The stitchbonded fabric was converted into a conformable panty for use over adult diapers, as described in the next paragraph with reference to FIGS. 3 and 4.

Stitchbonded fabric 30 was slit along lines 35 to form 20-inch-wide (51-cm-wide) strips of fabric, that were wound up flat, under light tension. Two rolls of fabric strips were fed to a sewing operation. The strips were fed flat, under tension, one atop the other, with lanes 31, 32 and 33 of the respective strips in register with each other. A continuous seam 42 was sewn along the length near the free edges of lanes 33 to join the bottom edges of both strips of fabric. Every 15 inches (38 cm) along the length of the assembled strips, two transverse rows of stitches 41, the rows being separated by about ¼ inch (0.6 cm), were sewn across lane 31 to join the two strips at the upper part of the assembled strips. Transverse cuts were then made across the entire width of the assembled fabric, parallel to and between the two rows of parallel stitches of lane 30. Release of the tension on the assembled fabric and subsequent washing and drying in a home laundry machine, resulted in finished panty 40 of FIG. 4. The waist (i.e., circumference) of panty 40 measured about 20 inches (50 cm) and was readily stretchable to about 60 inches (150 cm) and the minimum "crotch" dimension (i.e., parallel to seam 42) measured about 6 inches (15 cm).

TABLE 2

| | Example II (See FIG. 3) | | |
|---|---|---|---|
| Stitchbonding Lane | 31 | 32 | 33 |
| Front Bar | | | |
| LD Stitches/inch | 6 | 6 | 6 |
| TD Stitches/inch | 12 | 6 | 6 |
| Width, inches | 4 | 10 | 6 |
| Stitching thread | Y-3 | Y-3 | Y-3 |
| % RS | 280 | 280 | 280 |
| Pattern | 1-2, 1-0 | 1-2, 1-0 | 1-2, 1-0 |
| Back Bar | | | |
| LD Stitches/inch | — | — | 6 |
| TD Stitches/inch | — | — | 12 |
| Width, inch | — | — | 6 |
| Stitching thread | none | none | Y-4 |
| % RS | — | — | 70 |
| Pattern | — | — | 1-0, 1-2 |
| Stretchability as formed | | | |
| Weight, g/m² | 44 | 34 | 54 |
| Longitudinal, % | 260 | 200 | 80 |
| Transverse, % | 200 | 160 | 120 |
| Stretchability after wash/dry | | | |
| Longitudinal, % | 320 | 320 | 130 |
| Transverse, % | 270 | 280 | 160 |
| Maximum-to-Minimum Lane Stretchability | | | |
| As-formed Longitudinal | | 3.3 | |

TABLE 2-continued

| | Example II (See FIG. 3) | | |
|---|---|---|---|
| Stitchbonding Lane | 31 | 32 | 33 |
| Transverse | | | 1.7 |
| After wash/dry Longitudinal | | | 2.5 |
| Transverse | | | 1.7 |

EXAMPLE III

This example describes the production of a protective industrial garment from two layers of stitchbonded fabric of the invention. The fabric has four lanes of differing stretchability. The production of the fabric and industrial garment will be described with reference to FIGS. 5–8.

The starting fibrous layer for the fabric was a 3.0oz-/yd² (102-g/m²) felt of 1.65 dtex, 3.8-cm long Type-72 Nomex® aramid fibers (sold by E. I. du Pont de Nemours and Company). The layer was made by needle-felting a cross-lapped carded batt of the fibers with about 100 penetrations per square inch (about 40/cm²). Table 3 below summarizes the manner in which the layer was stitchbonded with stitching yarns Y-3 and Y-5. Yarn Y-3, the same 154-dtex, bare Lycra® spandex yarn as was used for making the fabric of Example 2, was used on the front bar of the stitchbonding machine to form 1-0,0-1 chain stitches in each lane of the stitchbonded fabric. Yarn Y-5, a 330 dtex Nomex® aramid polymer yarn (sold by E. I. du Pont de Nemours and Company) was used on the back bar to form 0-0,5-5 laid-in stitches in lanes 52 and 53, and 0-0,3-3 laid-in stitches in lane 55. No back bar yarn was used for lane 51.

Table 3 shows that the resultant product had high longitudinal stretchability in all lanes and rather modest transverse stretchability (i.e., about 20–40%) in each lane, except lane 51 which was of high transverse stretchability (i.e., >200%). Maximum-to-minimum lane stretchability ratios were 1.4 in the LD (as formed) and 10 in the TD.

Figure 7:
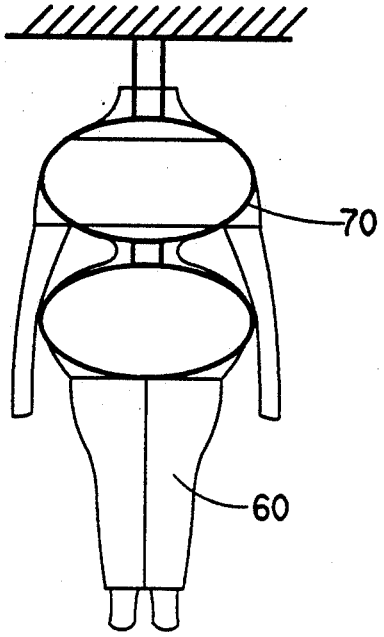
FIG. 7 is a schematic drawing of a contoured form 70 on which protective garment 60 is being heat treated.

The above-described stitchbonded fabric is fashioned into a conformable protective garment (the Nomex® fibers are fire resistant) as as follows. Stitchbonded fabric 50 is cut along lines 55 to form 78-inch-wide (198-cm-wide) strips that are wound up flat, under light tension. Two rolls of fabric strips are then fed to a sewing operation, with the strips flat, under tension, one atop the other. Lanes of the respective strips designated with the same numerals are in register with each other. Every 18 inches (46 cm) along the length of the assembled strips, transverse double rows of stitches 57, 58 and 59, and angled row of stitches 56, are sewn into the assembled strips of fabric to join the two strips together. Each of double rows of stitches 56, 57, 58 and 59 are two parallel rows separated by about ¼ inch (0.6 cm). Cuts are made between the two rows of stitches to form greige protective garments. The greige garments are then washed and dried (e.g., in home laundry equipment) to obtain completed protective garments. For easier subsequent donning, the washed-and-dried garment is fitted onto form 70, as shown in FIG. 7, to loosen the structure somewhat in the chest and hip areas of the garment. The garments are preferably further finished, while being stretched on form 70 by being heated for about two minutes at a temperature of about 190° C. Finished garment 60, depicted in FIG. 8, fits a wide range of human figures.

TABLE 3

| | Example III (FIG. 5) | | | |
|---|---|---|---|---|
| Stitchbonding Lane | 51 | 52 | 53 | 54 |
| Front Bar | | | | |
| LD Stitches/inch | 20 | 20 | 20 | 20 |
| TD Stitches/inch | 12 | 6 | 12 | 6 |
| Width, inches | 14 | 14 | 24 | 26 |
| Stitching thread | Y-3 | Y-3 | Y-3 | Y-3 |
| % RS | 100 | 100 | 100 | 100 |
| Pattern | 1-0, 0-1 | 1-0, 0-1 | 1-0, 0-1 | 1-0, 0-1 |
| Back Bar | | | | |
| LD Stitches/inch | — | 20 | 20 | 20 |
| TD Stitches/inch | — | 12 | 12 | 6 |
| Width, inch | — | 14 | 24 | 26 |
| Stitching thread | none | Y-5 | Y-5 | Y-5 |
| % RS | — | 15 | 15 | 15 |
| Pattern | — | 0-0, 5-5 | 0-0, 5-5 | 0-0, 3-3 |
| Stretchability as formed | | | | |
| Longitudinal, % | 210 | 170 | 150 | 170 |
| Transverse, % | 200 | 40 | 20 | 40 |
| Weight, g/m$^2$ | 108 | 214 | 217 | 159 |
| Stretchability after wash/dry | | | | |
| Longitudinal, % | 430 | 230 | 200 | 210 |
| Transverse, % | 200 | 30 | 20 | 30 |
| Maximum to-Minimum Lane Stretchability | | | | |
| As-formed Longitudinal | | 1.4 | | |
| Transverse | | 10.0 | | |
| After wash/dry Longitudinal | | 2.15 | | |
| Transverse | | 10.0 | | |

I claim:

1. A process for preparing a finished article from a stitchbonded stretchable fabric, the process comprising the steps of preparing a stretchable stitchbonded fabric having a length direction and a direction transverse thereto, by multi-needle stitching a layer of substantially nonbonded fibers of textile decitex with elastic thread to form spaced apart, parallel rows of stitches extending along the length of the fabric and at least a first stitchbonded region and a second stitchbonded region, the first stitchbonded region having a stretchability in one of said directions that is at least 1.5 times as great as the stretchability of the second region in the one said direction and the stretchability of at least one of the regions being at least 150%, seaming and cutting the fabric to match dimensions and stretchability characteristics of the different longitudinal regions of the fabric with dimensional and stretchability requirements of different regions of the finished article.

2. A finished article made by the process of claim 1.

3. A finished article in accordance with claim 2 wherein the article is a panty.

4. A finished article in accordance with claim 2 wherein the article is a protective garment.

5. A finished article in accordance with claim 2 wherein the article is a fitted mattress pad having a stretchable stitchbonded skirt.

* * * * *